US005524683A

United States Patent [19]

Mueller

[11] Patent Number: 5,524,683

[45] Date of Patent: Jun. 11, 1996

[54] METHOD AND APPARATUS FOR FILLING CONTAINERS

[75] Inventor: Martin J. Mueller, Palm Harbor, Fla.

[73] Assignee: Osgood Industries, Inc., Oldsmar, Fla.

[21] Appl. No.: 311,142

[22] Filed: Sep. 23, 1994

[51] Int. Cl.[6] ..... B65B 43/42; B67C 3/00

[52] U.S. Cl. ..... 141/129; 141/89; 141/258; 141/261; 222/148; 222/334; 222/253; 222/380; 222/387; 417/391

[58] Field of Search ..... 141/129, 89, 237, 141/238, 242, 163, 192, 258, 262, 261, 392; 222/148, 334, 387, 380, 253, 255; 417/391; 128/205.15–205.19

[56] References Cited

U.S. PATENT DOCUMENTS

| | | | |
|---|---|---|---|
| 1,690,067 | 10/1928 | Weeks | 141/242 |
| 3,648,741 | 3/1972 | Croasdale et al. | 141/9 |
| 3,695,486 | 10/1972 | Warner | 222/162 |
| 3,744,538 | 7/1973 | Nasica et al. | 141/242 |
| 3,901,279 | 8/1975 | Schnell | 138/31 |
| 3,934,625 | 1/1976 | Tiernan et al. | 141/115 |
| 4,234,107 | 11/1980 | Gernlein | 222/309 |
| 4,373,560 | 2/1983 | Elsworth | 141/129 |
| 4,457,348 | 7/1984 | Mueller et al. | 141/1 |
| 4,974,755 | 12/1990 | Sonntag | 222/309 |
| 5,127,449 | 7/1992 | Mueller et al. | 141/1 |

*Primary Examiner* Henry J. Recla
*Assistant Examiner* Timothy L. Maust
*Attorney, Agent, or Firm* Dressler, Goldsmith, Shore & Milnamow, Ltd.

[57] ABSTRACT

An apparatus for filling containers including a pump housing having a pump chamber, a product inlet in communication with a supply of product under pressure, a product outlet and a piston positioned therein. The piston is movable by the supply of product under pressure between advancing and retracting positions where product is discharged from the chamber and through the outlet during the advancing stroke and the chamber is filled with product during the retracting stroke. A first valve is included to regulate the flow of product through the outlet and a second valve is included to regulate the flow of product between opposite sides of the piston. By controlling the opening and closing of the first and second valves, the pressure of the product enables movement of the piston to eject product and fill the chamber as desired.

17 Claims, 6 Drawing Sheets

METHOD AND APPARATUS FOR FILLING CONTAINERS

FIELD OF THE INVENTION

The present invention relates generally to a method and apparatus for continuously and sequentially filling containers with a product, and more particularly to such a method and apparatus that utilizes pressure from the flow of a product, such as a food product, to consistently fill the containers with a precise amount of product.

BACKGROUND OF THE INVENTION

Food products that are substantially flowable, such as margarine, butter, sour cream, ice cream, yogurt or the like, typically are packaged in individual containers for retail sale and consumer use. Packaging of these types of food products is ordinarily effected with the use of fill pump devices and associated container conveyors that present containers in a continuous, sequential manner to the filling device which is operated to dispense food product to each of the containers.

In such systems, precise control of the filling device is necessary in order to assure that each container receives the desired quantity of product. In practice, such precision can be difficult to achieve due to inherent fluctuations in product consistency and temperature as well as the periodic start-up and shut-down of a filling line which typically complicates accurate filling of the containers.

Existing systems typically are either pneumatically controlled or cam-operated. Pneumatically controlled systems typically include pneumatically actuated pumping devices including a piston for dispensing the food product into the associated containers when the piston is advanced during a container-filling stroke. Pneumatic systems, however, are affected by inevitable fluctuations in air supply pressure, the limited service life of the pneumatic cylinders and the attendant problems of maintaining the various seals and like components of the system.

Cam-operated filling systems can provide enhanced product weight control as well as consistent, dependable operation of the pump device, which can be operated independently of or mechanically linked to the container conveyor. However, cam-operated systems cannot always deliver the desired pump piston velocity during initial start-up of the filling line, which can sometimes affect the appearance of the food product with which the containers are being filled. Additionally, such systems require the provision of cams, linkages, etc. necessary to effect pump operation.

It therefore would be desirable to provide a product filling method and apparatus which operates independently of the container conveyor and permits versatile, dependable operation of a filling system while maintaining the appropriate product weight and appearance under a wide variety of operating conditions. It would also be desirable to provide a system which minimizes product seals, operating linkages, and like components for reduced cost and enhanced reliability.

SUMMARY OF THE INVENTION

An apparatus for filling containers embodying the principles of the present invention has been particularly configured for improved operation and cleaning by providing an arrangement whereby the pressure of product being supplied to the apparatus effects its drive and operation. Not only does this obviate the need for an associated cam or pneumatic drive system, the apparatus is desirably configured to facilitate cleaning without substantial disassembly of the apparatus.

In accordance with the illustrated embodiment, the present apparatus includes a pump housing having a pump chamber therein. The housing includes a product inlet adapted to transfer food product under pressure from an associated supply of food product to the chamber, and a first product outlet adapted to deliver product to each container.

A piston is reciprocally movable in the pump chamber under the influence of the pressurized product. The product under pressure moves the piston between a first, retracted upper position and a second, advanced lower position within the chamber to provide advancing and retracting strokes during each pumping cycle. During the piston advancing stroke, product within a portion of the chamber, in front of the piston, is dispensed through the first product outlet, while a portion of the chamber on the rear side of the piston is simultaneously filled with new product as the pressurized product advances the piston.

During the piston retracting stroke, the portions of the pump chamber on opposite sides of the piston are joined in fluid communication, and product within the chamber portion on the rear side of the piston is transferred to the front side of the piston to be dispensed during the subsequent piston advancing stroke. The transferring of the product from the front side to the rear side of the piston itself provides for return movement of the piston within the chamber from the second position back to the first position.

To provide for the flow of the product into and out of the pump chamber, a first outlet valve member is provided to selectively open and close the first product outlet and regulate the flow of product therethrough. One or more selectively openable second valve members also are provided to selectively join opposite sides of the piston in communication and thereby enable the flow of product between opposite sides of the piston. By regulating the opening and closing of the first and second valve members, the product flow between the opposite sides of the piston is provided thereby advancing and retracting the piston.

To provide the piston advancing stroke, the first outlet valve is opened while the second valve or valves are closed. Product under pressure then is introduced from the inlet into a first portion of the pump chamber to the first rear side of the piston which enables advancing of the piston between the first upper position to the second lower position while ejecting product on the front side of the piston through the outlet.

To provide the piston retracting stroke, the first outlet valve member is closed while the second valve or valves are opened to permit product to flow to the front side of the piston. The pressure supplied by the product inlet contacts the larger surface area of the front side of the piston to propel the piston from the second position to the first position. Accordingly, the pressure of the product itself provides both the advancing and retracting strokes of the piston.

In a preferred embodiment of the invention the piston includes a piston head having one or more product flow channels extending therethrough interconnecting opposite sides of the piston head. The second valves are respectively positioned within the product flow channels and can be activated from the exterior of the apparatus to open and close the product flow channels as desired.

In another embodiment of the invention, the housing includes an auxiliary product flow path connecting opposite ends of the pump chamber and opposite sides of the piston head. The second valve member is positioned within the auxiliary product flow path and can be activated from the exterior of the apparatus to open and close the auxiliary product flow path as desired.

In either embodiment, the first and second valve members preferably are diaphragm type pinch valves which provide a straight through flow of product with good cleanability of the valve. Additionally, the design of the apparatus provides product on both sides of the piston and very desirably eliminates the need for any "O" rings on the piston for sealing opposite sides thereof.

The piston includes a piston stem which can extend out of the housing, with an arrangement provided for wiping or cleaning the piston stem. If desired, the piston stem can operably connect with a separate pneumatic cylinder for balance of forces acting on the piston. The cylinder can also be operated to act as a volume stop or to assist in retraction of the piston. To balance or maintain the pressure of the product infeed line or other portions of the apparatus, one or more flow compensators also can be provided.

Additionally, to recirculate product through the apparatus, the housing can include a recirculation outlet controlled by its own valve member. The recirculation outlet can be utilized to circulate any stale or residual product out of the apparatus as desired and can be utilized for cleaning.

Other features and advantages of the present invention will become readily apparent from the following description, the accompanying drawings and the appended claims.

DESCRIPTION OF THE PREFERRED EMBODIMENTS

Figure 1:
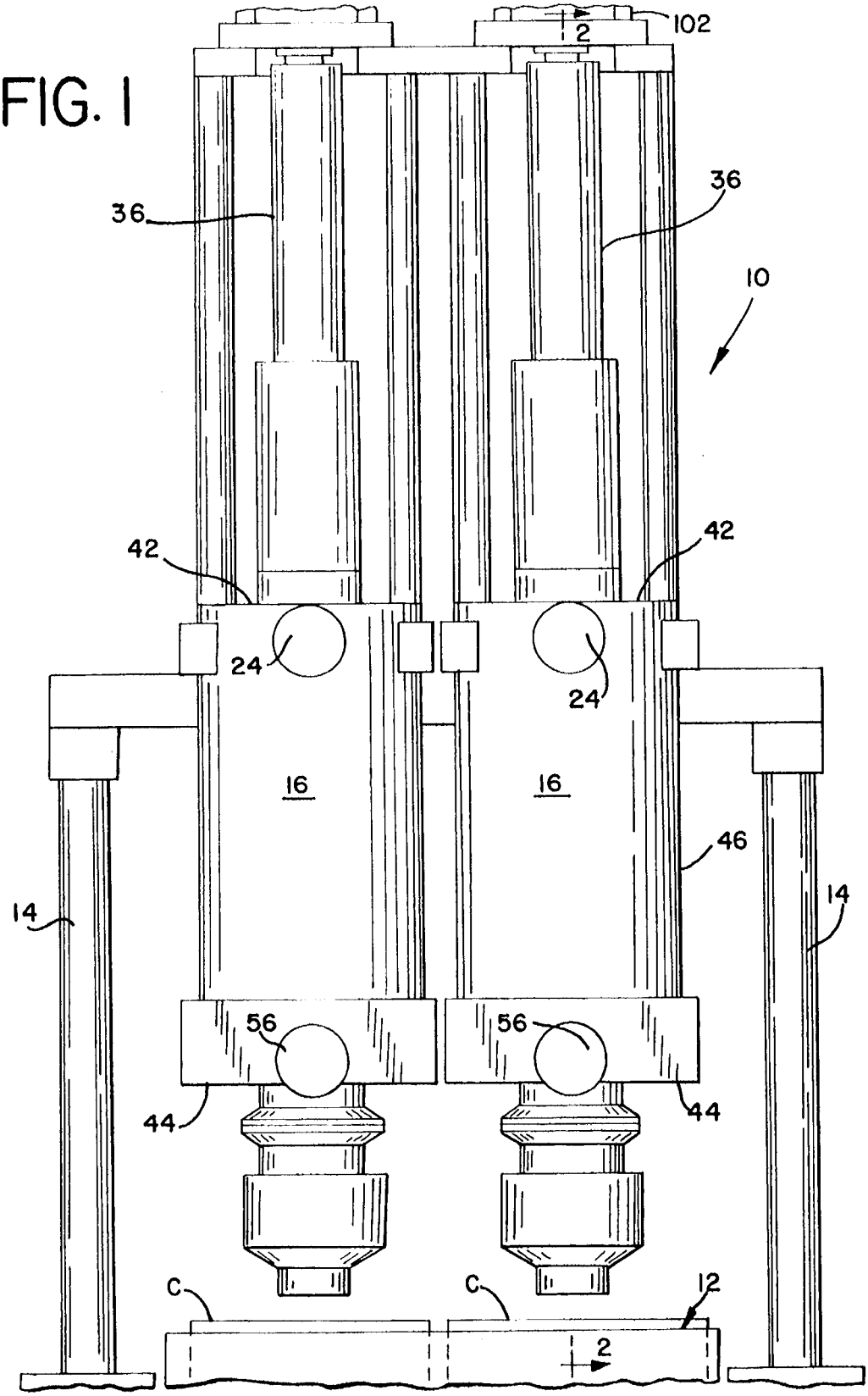
FIG. 1 is a front elevational view of a portion of a product filling apparatus embodying the principles of the present invention, including two food product pumps of the present invention for filling separate containers passing therebelow.

While the present invention is susceptible of embodiment in various forms, there are shown in the drawings and will hereinafter be described preferred embodiments of the invention, with the understanding that the present disclosure is to be considered as an exemplification of the invention, and is not intended to limit the invention to the specific embodiments illustrated.

Referring to FIG. 1, a product filling apparatus embodying the principles of the invention is generally designated by the reference numeral 10. The filling apparatus 10 is configured for use with an associated container conveyor 12 which conveys containers C generally beneath the filling apparatus 10 whereby the containers C are continually and sequentially filled with food product. Filling apparatus 10 can be suitably employed for filling containers C with flowable food product, particularly dairy food products such as butter, margarine, sour cream, ice cream, yogurt or the like.

The filling apparatus 10 is straightforward in configuration for reliable and consistent operation with minimal maintenance and ease of cleaning. The apparatus 10 includes a generally upstanding frame 14 on which preferably are mounted two food product pumps 16 of substantially identical configuration carried by mounting brackets 18.

Accordingly, the apparatus 10 preferably fills two containers C simultaneously as they pass underneath. It is to be understood, however, that the particular number of pumps 16 can vary to in turn vary the number of containers C being filled.

Figure 2:
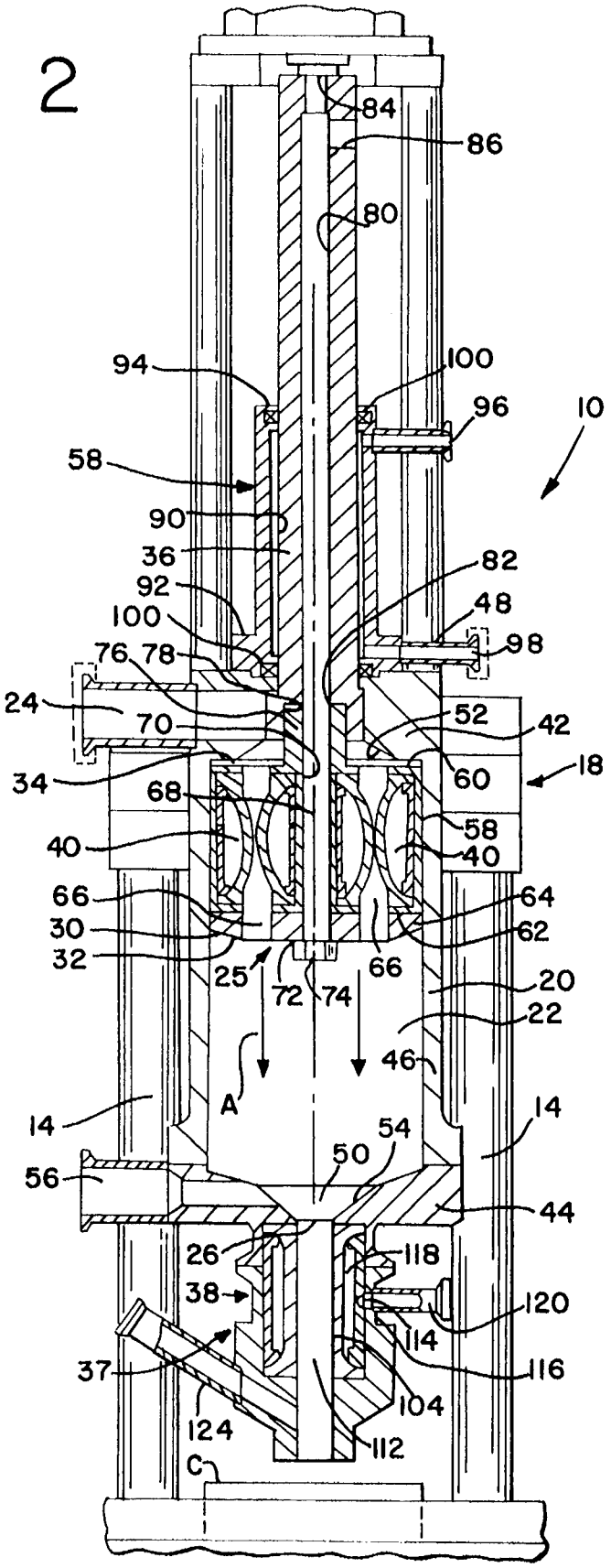
FIG. 2 is a longitudinal cross-sectional view of one of the food product pumps of the invention taken along line 2—2 of FIG. 1 and in the direction indicated illustrating a piston of the pump in a retracted position with a first outlet valve member open and second valve members closed in preparation for advancing the piston.

As FIG. 2 illustrates, in a first embodiment of the invention each pump 16 includes a pump housing 20 which defines a pump chamber or cavity 22. The housing 20 includes a product inlet 24 and a first product outlet 26 extending therethrough for communication with the chamber 22.

A reciprocating piston 28 is also included and is movable within the chamber 22. The piston 28 includes a piston head 30 having a front surface 32 and a rear surface 34 with a stem 36 extending therefrom.

To control the flow of food product out of the outlet 26 and enable operation of the piston 28 as described below, the outlet 26 is in communication with an outlet nozzle 37 including an outlet valve 38 therein. The outlet valve 38 cooperates with one or more product flow control valves 40 that are substantially identical to the outlet valve 38. In this embodiment, the valve or valves 40 extend through the piston head 30 to control the flow of food product between the front surface 32 and the rear surface 34 of the piston head 30. The valves 40 thus are configured to selectively join, in fluid communication, portions of the chamber 22 or respective opposite sides of the piston 28.

By selectively activating the outlet valve 38 and the product flow control valves 40 the pressure of the food product alone can be utilized to drive the piston 28. This feature not only eliminates the need for an external piston driving mechanism, but also greatly reduces the complexity of the apparatus 10 to reduce costs while enabling enhanced performance and easier cleaning.

Figure 5:
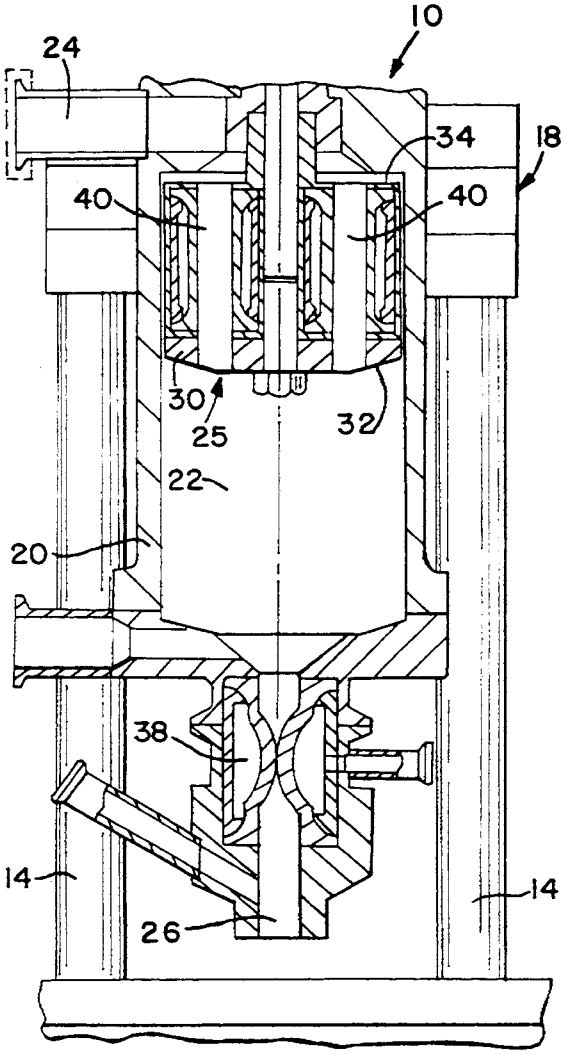
FIG. 5 is a longitudinal cross-sectional view, similar to FIG. 4, illustrating the piston in the retracted position.
Figure 3:
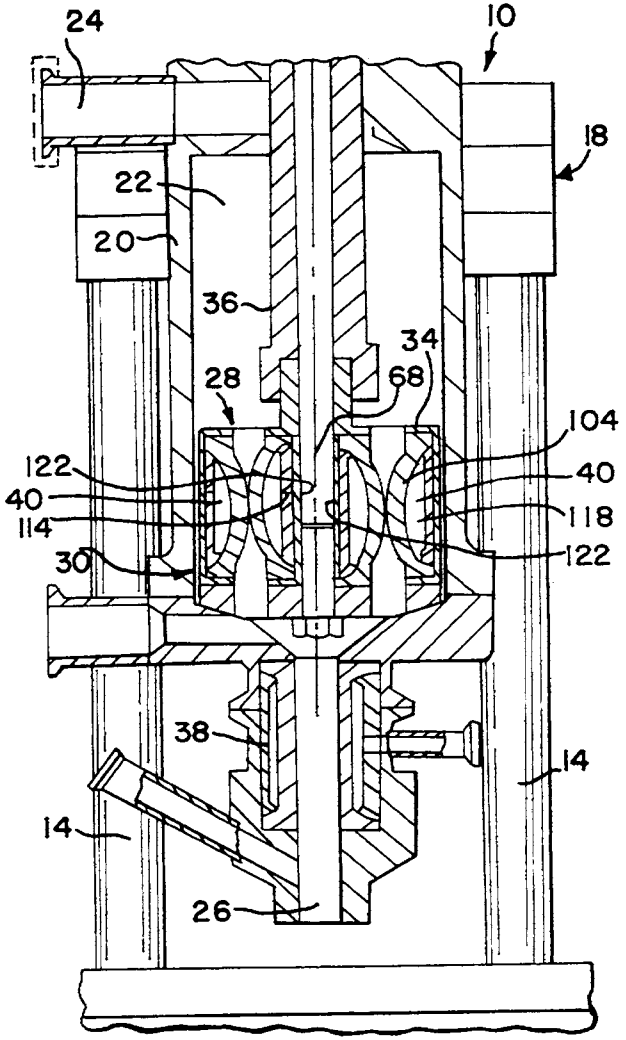
FIG. 3 is a longitudinal cross-sectional view, similar to FIG. 2, illustrating the piston in an advanced position.

In operation, the piston 28 is cyclically driven by the product under pressure supplied by the inlet 24 between a first, retracted upper position within the chamber 22, illustrated in FIG. 2, to a second, advanced lower position, illustrated in FIG. 3. Before dispensing product, the chamber 22 must first be filled with product from the inlet 24. As FIG. 5 illustrates, by opening the valves 40 and closing the valve 38, product can fill the chamber 22 from the inlet 24.

In order to dispense product within the chamber 22 in front of the piston 28 from the outlet 26 to an associated container C, the product flow control valves 40 are closed and the outlet valve 38 is opened, as illustrated in FIG. 2. In this position, pressure is provided against the rear surface 34 of the piston head 30 by the food product supplied by the inlet 24 to advance the piston 28 downward within the chamber 22 in the direction of arrow "A" from the first upper position to the second lower position within the chamber 22.

As the piston 28 advances under the influence of the pressurized product acting on the rear surface of the piston, product within the chamber 22 between the front surface 32 of the piston head 30 and the outlet 26 is forced through the open outlet valve 38 out of the outlet 26 and into the desired container C. As the piston head 30 is advanced to the lower position illustrated in FIG. 3, the chamber 22 between the rear surface 34 of the piston head 30 and the inlet 24 is simultaneously filled with food product for the next cycle.

Figure 4:
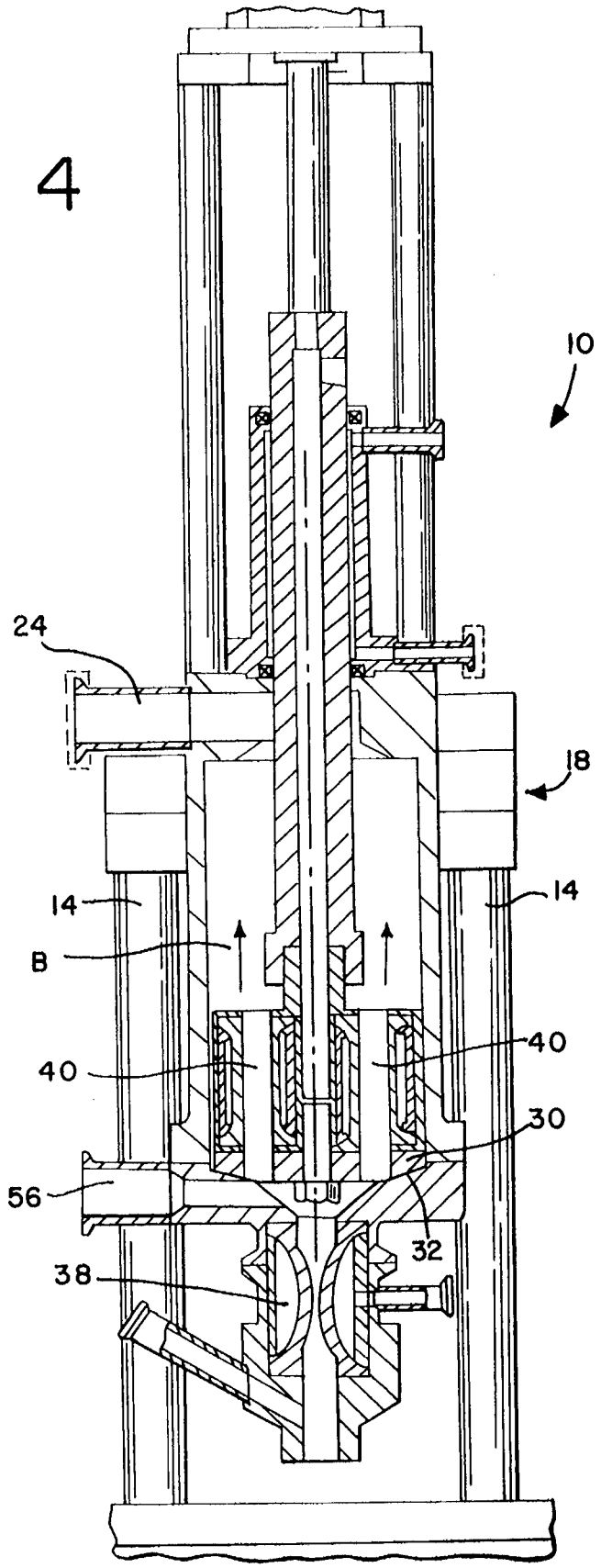
FIG. 4 is a longitudinal cross-sectional view, similar to FIGS. 2 and 3, illustrating closing of the first outlet valve member and opening of the second valve members within the piston head in preparation for retracting the piston.

To return the piston to the upper position within the chamber 22 for dispensing product to a subsequent container C, the outlet valve 38 is closed and the product flow control valves 40 are opened as illustrated in FIG. 4. Food product under pressure then flows through the valves 40 to the front surface 32 of the piston head 30 which causes the piston head 30 to retract to the top of the chamber 22 in the direction of arrow "B" due to the larger surface area of the front surface 32 compared to the rearward surface or "rod side" of the piston.

As the piston head 30 is retracted from the second lower position illustrated in FIG. 4 to the first upper position illustrated in FIG. 5, the piston head 30 moves through the food product within the chamber 22 and is positioned for a subsequent advancing stroke. This continuous cycle of advancing and retracting the piston head 30 provides filling of containers C at a desired speed and consistency.

Structural details of the apparatus 10 now will be described. It is to be understood, however, that the particular structure of the apparatus 10 can vary so long as it functions as described herein.

As FIGS. 1 and 2 illustrate, the pump housing 20 preferably is formed from metal, such as stainless steel, substantially is cylindrical in shape and is oriented in a vertical plane. The particular material, shape and orientation of the pump housing 20, however, can vary.

The pump housing 20 is defined by a first circular top portion 42 including the product inlet 24 extending laterally therein, a second circular bottom portion 44 proximate the outlet 26 and a cylindrical side wall 46 extending therebetween. To enable the piston stem 36 to exit the pump housing 20, the first top portion 42 includes a first aperture 48 extending therethrough.

To provide flow of food product out of the pump housing 20, the second bottom portion 44 includes a second aperture 50 extending therethrough. Preferably, both the first and second apertures 48 and 50 include tapered portions 52 and 54, respectively, to assist in the flow of food product.

To enable product to recirculate out of the pump chamber 22, such as during periods when the container conveyor is not operating, the second bottom portion 44 of the pump housing 20 includes a secondary outlet 56 controlled by a valve (not illustrated). As explained in detail below, the secondary outlet 56 can be opened to recirculate product out of the pump housing 22 back into the food product supply or to a waste container or the like.

As FIG. 2 illustrates, the piston head 30 preferably is cylindrical in shape defined by a piston housing 58 having a first end 60 and a second end 62 which is substantially covered by a piston plate 64. The piston head 30 includes one or more flow channels 66 extending therethrough for interconnecting the front surface 32 to the rear surface 34 of the piston head 30.

Preferably, two or four flow channels 66 are provided in a desired positions about the piston head 30, each having a respective product flow control valve 40 positioned therein. The particular number and positioning of the flow channels 66, however, can vary.

To connect the piston plate 64 to the piston housing 58 and provide compressed air to the flow control valves 40 from the piston stem 36, the housing 58 includes a central bore 68 having a first top end 70 and a second bottom end 72. The second bottom end 72 of the bore 68 is threaded for accepting a bolt 74 therein for securing of the piston plate 64.

To connect the piston stem 36 to the piston housing 58, an exterior surface of the closed end 60 of the piston housing 58 includes a ferrule 76. The ferrule 76 is retained within a corresponding channel 78 formed within the piston stem 36 and includes the bore 68 extending therethrough.

To provide compressed air to the bore 68 and the flow control valves 40, the piston stem 36 includes a central passageway 80 extending along its length. A first end 82 of the passageway 80 is aligned with the bore 68 while a second end 84 is closed. To supply compressed air to the passageway 80, a compressed air outlet 86 is provided in the piston stem 36 connected to a compressed air supply hose (not illustrated) which preferably moves with the piston stem 36.

Since food product is provided on both the front surface 32 and the rear surface 34 of the piston head 30, no sealing or "O" rings are required about the periphery of the piston head 30 for sealing engagement with the cylindrical sidewall 46 of the pump chamber 22. To prevent contamination of the food product within the pump chamber 22, the piston stem 36 enters a scrubbing, purging and sealing assembly 88 as it exits the top aperture 48 in the pump housing 20.

The assembly 88 is secured to the exterior of the top housing portion 42 and includes an interior chamber 90, first and second opposite ends 92 and 94, an inlet 96 and an outlet 98. To seal and wipe the piston stem 36 within the chamber 90, two "O" rings 100 are provided, one each proximate the first and second opposite ends 92 and 94.

The inlet 96 and outlet 98 convey a cleaning medium, such as air, fluid or the like, to flood the chamber 90. The particular cleaning medium can vary, and can be at a high temperature if desired, so long as it provides cleaning of the piston stem 36 as it travels through the assembly 88.

Accordingly, as the piston stem 36 moves during the advancing stroke of the piston 28, a portion of the stem 36 within the cleaning assembly 88 enters the pump housing 20. As the piston 28 is retracted, that same portion of the stem 36 re-enters the cleaning assembly 88. Thus, the sterility of the apparatus 10 is maintained during operation.

As FIG. 1 illustrates, if necessary, in order to assist in moving the piston 28 during the retraction stroke the second closed end 84 of the piston stem 36 can be connected to an air or fluid actuated cylinder or similar driving mechanism generally illustrated with the reference numeral 102. The air cylinder 102 also can be utilized for selectively balancing and adjusting the effect of the food product pressure acting on the piston 28. The cylinder 102 can also selectively control the volume of product dispensed during each pumping cycle.

Figure 6:
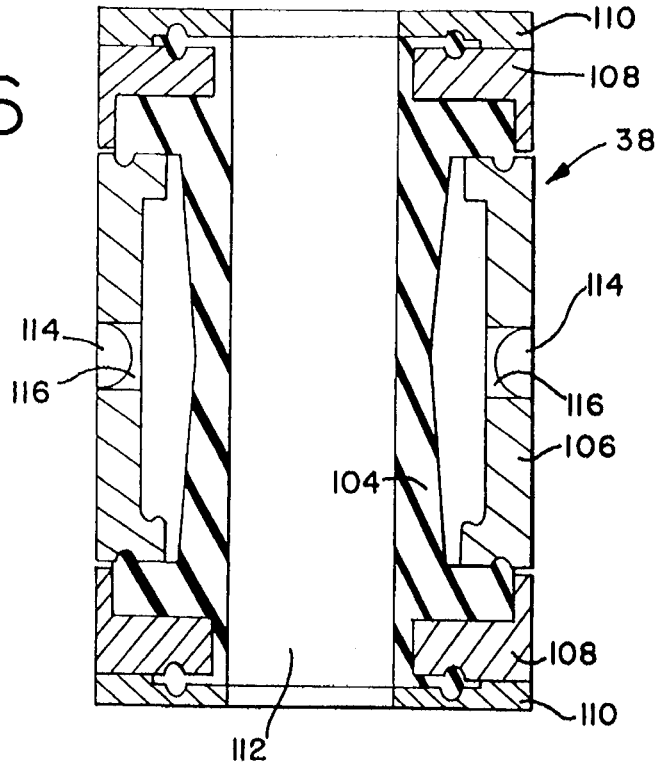
FIG. 6 is a an enlarged cross-sectional view of a diaphragm pinch valve of the invention illustrated in its open position.
Figure 7:
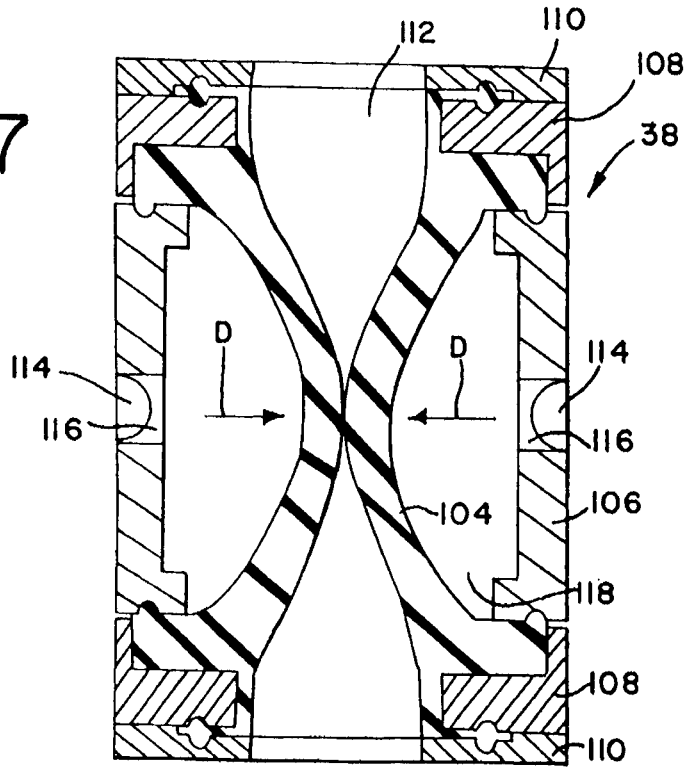
FIG. 7 is an enlarged cross-sectional view of the diaphragm pinch valve of FIG. 6 illustrated in its closed position.

FIGS. 6 and 7 illustrate structural details of the outlet valve 38, it being understood that such details also apply to the product flow control valves 40. The valve 38 is designed as a "pinch" type diaphragm valve and includes a substantially flexible, cylindrical pinch valve element 104, a first cylindrical housing portion 106, two secondary housing portions 108 and two housing end plates 110.

As FIG. 6 illustrates, in the at-rest position of the outlet valve 38 the pinch valve element 104 defines a longitudinal channel 112 extending therethrough for conveying food product. As FIG. 7 illustrates, when activated, preferably by compressed air, the pinch valve element 104 collapses substantially along a central lateral axis as illustrated by arrows "D" to close off the longitudinal channel 112 and prevent the flow of food product therethrough.

To provide the compressed air as desired to operate the outlet valve 38, the first cylindrical housing portion 106 includes a central lateral channel 114 formed about its periphery. The first housing portion 106 preferably includes three apertures 116 formed therethrough and positioned within the channel 114 which communicate compressed air between the lateral channel 114 and a chamber 118 formed between the first housing portion 106 and the pinch valve element 104.

With regard to the outlet valve 38, as FIG. 2 illustrates the outlet nozzle 37 includes an air supply inlet 120 in operable communication with the central lateral channel 114. Accordingly, when the air supply inlet 120 is activated, air flows from the inlet 120, into the lateral channel 114, through the apertures 116 and into the chamber 118 to collapse or "pinch" the pinch valve element 104 to close off the channel 112.

Similarly, with regard to the product flow control valves 40, air flows from the air outlet 86 proximate the second closed end 84 of the piston stem 36, through the stem passageway 82 and into the bore 68 of the piston head 30. As FIG. 3 illustrates, the bore 68 includes at least one lateral outlet 122 for each flow control valve 40 which provides a flow of air from the bore 68 into the lateral channel 114 of each flow control valve 40.

Accordingly, when the air outlet 86 is activated, air flows down the stem passageway 80, into the bore 68, the channel 114, through the apertures 116 into the chamber 118 to collapse or "pinch" the pinch valve element 104 and close the pinch channel 112.

Referring to FIG. 4, in order to recirculate or purge the chamber 22, the outlet valve 38 is closed and the product flow control valves 40 are opened. With the piston 28 in the lower or upper position within the chamber 22, the secondary recirculating outlet 56 then is opened. Food product thus flows from the product inlet 24 into the chamber 22, through the open flow control valves 40 and out of the secondary recirculating outlet 56 for recycling or disposal.

As FIG. 2 illustrates, in order to clean out the outlet nozzle 37, a flow tube 124 can be provided in operable communication with the outlet nozzle 37. During cleaning of the apparatus 10, a cleaning medium, such as air, water, a sterilizing solution or the like, can be flushed through the flow tube 124 to clean and/or sterilize the outlet nozzle 37.

In order to maintain the proper pressure of the food product to the inlet 24, one or more product flow compensators (not illustrated) can be provided. The type and position of such flow compensators can vary so long as they provide a substantially constant supply of food product to the apparatus 10 and at a desired pressure.

Figure 8:
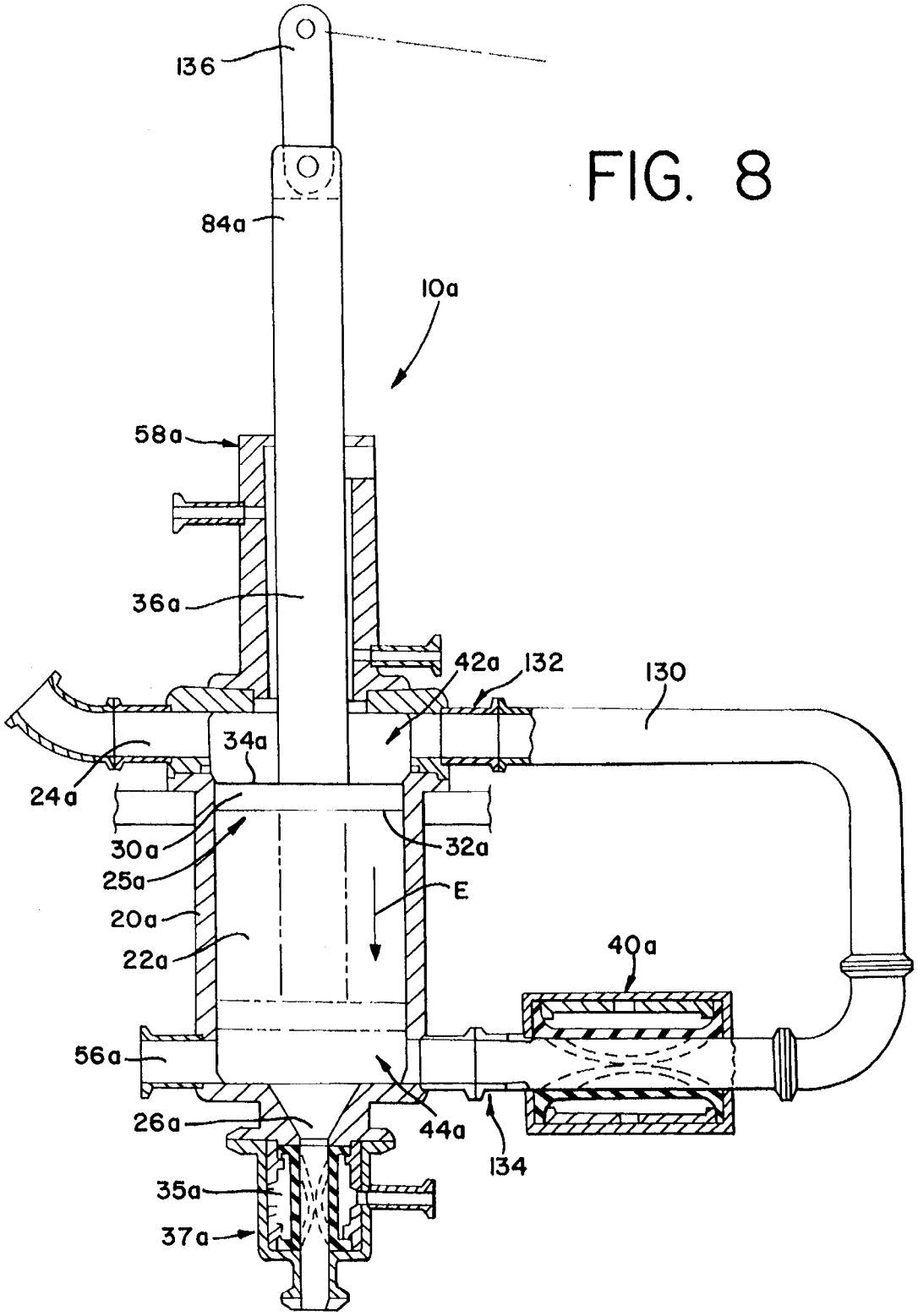
FIG. 8 is a longitudinal cross-sectional view illustrating another embodiment of the food product pump of the invention.

FIG. 8 illustrates another embodiment of the apparatus 10*a* where similar elements are identified with the same reference numerals as in the embodiment of FIGS. 1–7 and including the subscript "a". In this embodiment, the piston head 30*a* is provided without the flow control valves 40.

In order to provide product flow between opposite sides of the piston head 30*a* and the desired advancing and retracting strokes, an auxiliary product flow path or conduit 130 is provided. The flow path 130 includes a first end 132 in operable communication with the top portion 42*a* of the pump chamber 22*a* and a second end 134 in operable communication with the bottom portion 44*a* of the pump chamber 22*a*.

To control the flow of product through the flow path 130, a product flow control valve 40*a* is positioned therein which is similar to the product flow control valve 40 of the previous embodiment. Although the flow control valve 40*a* is positioned proximate the second end 134 of the flow path 130, it can be placed anywhere along the length of the flow path 130 if desired.

In operation, the piston 28*a* is driven within the pump chamber 22*a* by the product under pressure supplied by the inlet 24*a* between a first, retracted upper position illustrated in solid lines to a second, advanced lower position illustrated in dotted lines. In order to dispense product from the outlet 26*a* to an associated container, the piston head 30*a* is positioned in the first upper position within the chamber 22*a*, the chamber 22*a* is initially filled with product, the product flow control valve 40*a* is closed and the outlet valve 38*a* is opened.

In this position, pressure is provided against the rear surface 34*a* of the piston head 30*a* by the food product supplied by the inlet 24*a* to advance the piston 28*a* downward within the chamber 22*a* in the direction of arrow "E" from the first upper position to the second lower position. As the piston 28*a* advances, product within the chamber 22*a* between the front surface 32*a* of the piston head 30*a* and the outlet 26*a* is forced through the open outlet valve 38*a* out of the outlet 26*a* and into the desired container.

As the piston head 30*a* is advanced to the second bottom position illustrated in dotted lines, a portion of the chamber 22*a* between the rear surface 34*a* of the piston head 30*a* and the inlet 24*a* is simultaneously filled with food product for the next cycle.

To return the piston to the first upper position within the chamber 22*a* for dispensing product to a subsequent container, the outlet valve 38*a* is closed and the product flow control valve 40*a* is opened. Food product under pressure then flows through the auxiliary flow path 130 and the valve 40*a* to the front surface 32*a* of the piston head 30*a* which causes the piston head 30*a* to retract to the top of the chamber 22*a* due to the larger surface area of the front surface 32*a*.

To assist in movement of the piston 28*a* and provide volume control, if desired, an air or fluid control cylinder (not illustrated) can be connected to the second closed end 84*a* of the piston stem 36*a*. Alternatively, the second closed end 84*a* can include a lever arm or link 136 or similar member which can be operated pneumatically or by a cam mechanism.

Suitable automatic, electronic controls facilitate operation and coordination of the apparatus 10 with the container conveyor 12. A signal from the container conveyor 12 is employed for coordinating operation of the apparatus 10 with the conveyor 12, although the apparatus 10 can be selectively operated independently of the speed of the conveyor 12.

Thus, it will be appreciated that the present filling apparatus 10 greatly facilitates accurate packaging of food product with a desired consistency and in an aseptic manner. Since the pressure supplied by the food product itself propels the piston 28, no expensive linkages, cams or motors are required which significantly reduces the size and cost of the apparatus 10.

Additionally, since food product flows on both the front and rear side of the piston 28, no sealing or "O" rings are required on the piston 28. By using pinch valves, a straight through design is provided which enhances the cleanability of the design and enables clean-in-place or CIP cleaning where disassembly of the apparatus 10 is not required for cleaning.

Despite the small, compact design, the apparatus 10 can handle extreme line pressures while providing excellent volume adjustment. Furthermore, due to the simple design, the apparatus 10 readily can be disassembled for service or repair if needed.

From the foregoing, it will be observed that numerous modifications and variations can be effected without departing from the true spirit and scope of the novel concept of the present invention. It is to be understood that no limitation with respect to the specific embodiments illustrated herein is intended or should be inferred. The disclosure is intended to cover by the appended claims all such modifications as fall within the scope of the claims.

I claim:

1. An apparatus for filling containers being conveyed by an associated container conveyor, said apparatus comprising:

a pump housing having a pump chamber, a product inlet adapted to receive food product under pressure from an associated food product supply and deliver said product to said pump chamber and a first product outlet adapted to deliver said product to each of said containers;

a piston reciprocally movable in said pump chamber by said product under pressure to provide a pumping cycle including piston advancing and retracting strokes during each pumping cycle, said product being discharged from said pump chamber and through said first product outlet during said advancing stroke and said chamber being filled with product from said product inlet during said retracting stroke;

a first valve member operable to open and close said first product outlet; and at least one second valve member operable to provide said advancing and retracting strokes of said piston by said product under pressure upon opening and closing of said first valve member, respectively, by enabling the flow of product between opposite sides of said piston.

2. An apparatus for filling containers in accordance with claim 1 wherein said piston includes at least one product flow channel therethrough and said at least one second valve member is positioned within said at least one product flow channel.

3. An apparatus for filling containers in accordance with claim 1 wherein said pump housing includes an auxiliary product flow path operably connecting opposite ends of said pump chamber and opposite sides of said piston and said at least one second valve member is positioned within said auxiliary flow path.

4. An apparatus for filling containers in accordance with claim 1 wherein said first and second valve members are pinch valves selectively activated to open and close as desired.

5. An apparatus for filling containers in accordance with claim 1 wherein said pump chamber includes a recirculation outlet and an associated control valve for recirculating product through said apparatus between said product inlet and said recirculation outlet upon closing of said first valve member.

6. An apparatus for filling containers in accordance with claim 1 including a piston drive mechanism independently driven with respect to the pressure exerted by the flow of product.

7. An apparatus for filling containers in accordance with claim 1 wherein said piston includes a piston stem which is extendible to an exterior of said housing for operable connection with a mechanism for cleaning said piston stem.

8. An apparatus for sequentially filling a plurality of containers each with a quantity of flowable product, comprising:

housing means having product inlet means adapted to receive a supply of food product from an associated source of food product under pressure, and product outlet means adapted to deliver said product to each said container; and cyclical pump piston means associated with said housing means and driven by said pressure provided by said food product for cyclically forcing product within said housing means through said outlet means during an advancing stroke of said piston means and for refilling said housing means with product from said inlet means during a retracting stroke of said piston means.

9. An apparatus for filling containers in accordance with claim 8 including product flow means for selectively providing food product under pressure from said food product inlet to opposite sides of said piston means for providing said advancing and retracting strokes as desired.

10. A method of filling containers being conveyed by an associated container conveyor, comprising the steps of:

providing a supply of food product under pressure;

positioning a food product pump having an outlet in operative association with said conveyor wherein said pump includes a housing defining a pump chamber and pump piston means reciprocally movable in said pump chamber to provide advancing and retracting strokes during a pumping cycle;

providing said pump chamber with first and second portions for movement of said pump piston means therebetween during said cycle, said first portion being in communication with said food product supply and said second portion being in communication with said pump outlet; and moving said pump piston means by said pressure of said supply of food product so that during each pumping cycle (1) food product is received in said first portion of said pump chamber from said food product supply to provide said advancing stroke of said piston means and force food product out of said second portion of said pump chamber and through said pump outlet and (2) food product is received in said second portion of said pump chamber from said food product supply to provide said retracting stroke of said piston means.

11. A method in accordance with claim 10 including providing a first valve member for controlling said pump outlet and providing a second valve member for controlling movement of said product flow between said first and second portions of said pump chamber and selectively activating said first and second valve members to provide said piston cycle.

12. A method in accordance with claim 11 including opening said first valve member and closing said second valve member to provide said piston advancing stroke.

13. A method in accordance with claim 11 including closing said first valve member and opening said second valve member to provide said piston retracing stroke.

14. A method in accordance with claim 10 including moving said food product from said food product supply between said first and second portions of said pump chamber and opposite sides of said piston through at least one flow channel through said piston.

15. A method in accordance with claim 10 including moving said food product from said food product supply between said first and second portions of said pump chamber and opposite sides of said piston through an auxiliary food product flow path extending about an exterior portion of said pump chamber.

16. A method in accordance with claim 10 including recirculating product through said pump chamber between said product inlet and a recirculation outlet of said pump chamber.

17. A method in accordance with claim 10 including assisting said retracting stroke of said piston with a piston drive mechanism independently driven with respect to the pressure exerted by the product flow.

* * * * *